US008136315B2

(12) United States Patent
Bai

(10) Patent No.: US 8,136,315 B2
(45) Date of Patent: Mar. 20, 2012

(54) CONNECTING DEVICE FOR CURTAIN WALL UNITS

(75) Inventor: Baokun Bai, DongGuan (CN)

(73) Assignee: Guangdong Kin Long Hardware Products Co., Ltd., Guangdong Province (CN)

( * ) Notice: Subject to any disclaimer, the term of this patent is extended or adjusted under 35 U.S.C. 154(b) by 218 days.

(21) Appl. No.: 12/418,771

(22) Filed: Apr. 6, 2009

(65) Prior Publication Data

US 2009/0249736 A1 Oct. 8, 2009

(30) Foreign Application Priority Data

Apr. 7, 2008 (CN) ..... 2008 2 0093082 U

(51) Int. Cl.
*E04H 1/00* (2006.01)
*E04H 3/00* (2006.01)
*E04H 5/00* (2006.01)
*E04H 14/00* (2006.01)

(52) U.S. Cl. ..... 52/235; 52/471; 52/665; 52/241; 52/511; 52/584.1

(58) Field of Classification Search ..... 52/235, 52/459, 471, 664, 665, 240, 241, 511, 584.1
See application file for complete search history.

(56) References Cited

U.S. PATENT DOCUMENTS 3,221,453 A * 12/1965 Lietaert ..... 52/209
3,762,110 A * 10/1973 Boss, Jr. ..... 52/63
5,040,347 A * 8/1991 Valvis ..... 52/204.591
5,065,557 A * 11/1991 Laplante et al. ..... 52/235
5,253,459 A * 10/1993 Parinas et al. ..... 52/235
5,579,794 A * 12/1996 Sporta ..... 135/88.01
5,839,236 A * 11/1998 Frey ..... 52/235

* cited by examiner

*Primary Examiner* — Eileen D Lillis
*Assistant Examiner* — Chi Nguyen
(74) *Attorney, Agent, or Firm* — Rosenberg, Klein & Lee

(57) ABSTRACT

A connecting device for curtain wall units is disclosed. The connecting device comprises: a claw arm having a horizontal arm for carrying the curtain wall units; a plurality of clamping plates, each two clamping plates fixed on the horizontal arm to clamp the curtain wall units; and a claw base connected to the claw arm and a supporting structure of the curtain wall units. The weight of curtain wall is supported by the claw arm of the connecting device, and point-supported type clamping of the curtain wall is realized by the clamping plates on the end of the claw arm, which enables the stability and security of the structure of curtain wall. The claw arm is hidden in the space between the curtain walls, and thus the whole appearance of curtain wall is beautified. Furthermore, it is unnecessary to provide through holes on the glass wall units.

9 Claims, 3 Drawing Sheets

CONNECTING DEVICE FOR CURTAIN WALL UNITS

BACKGROUND OF THE INVENTION

The present invention relates to an architectural hardware, and in particular to a connecting device for curtain wall units such as glass curtain wall units.

Glass curtain wall is widely used as the outer wall of building. In recent decades, point-supported glass curtain wall has been widely used in large public facilities due to its high security, good light transmission, nice ornamentation, variety of structure, convenience for maintenance, high technology, etc.

During the assembly of the point-supported glass curtain wall, holes are generally provided on the edge portions of the glass curtain wall, and connecting elements are inserted into the holes to joint the glass curtain wall units which are then coupled to a supporting structure on the building by claw-shaped connectors. Thus, it is necessary to provided holes on the four corners of the glass curtain wall unit respectively in order to carry out the assembly. As is well known, the holes on the friable glass should be generated by a special device, which is of relative low efficiency and also is abase of time and effort, and the glass strength is reduced, easy to be broken and may raise security problems due to the holes on the four corners.

Accordingly, the above-mentioned connecting device for curtain wall units has obvious defects and inconvenience in practical use, and an improvement to the connecting device is desired.

SUMMARY OF THE INVENTION

Having outlined the state of the prior art and its attendant shortages, it is an object of the present invention to provide a connecting device to ensure the stability of clamping the curtain wall units, wherein the curtain wall units are carried by a claw arm hidden in the space between the curtain wall units.

The above object of the present invention is achieved by the following technical solutions:

A connecting device for curtain wall units comprises:

a claw arm having a horizontal arm for carrying the curtain wall units;

a plurality of clamping plates, each two clamping plates fixed on the horizontal arm to clamp the curtain wall units; and a claw base connected to the claw arm and a supporting structure of the curtain wall units.

Preferably, the claw arm may further comprise a vertical arm integrated with the horizontal arm.

Preferably, the claw arm may comprise two horizontal arms and two vertical arms which are fixed to each other to be cross-shaped and disposed among four adjacent curtain wall units.

Preferably, the top surface of the horizontal arm may be provided with a recess for receiving a spacer plate.

Preferably, each two clamping plates may be fixed right against each other on the outer surface and the inner surface respectively.

Preferably, each two clamping plates may be mounted on an end of the horizontal arm distant from the claw base.

Preferably, the clamping plate may be fixed to the horizontal arm by screw.

Preferably, the claw arm may be fixed to the claw base by screw.

Preferably, the claw base may be retained on a standing rope.

Preferably, the claw base may be fixed to a frame of the curtain wall or a ribbed plate of the curtain wall.

With the above-mentioned structure, the weight of curtain wall is supported by the claw arm of the connecting device, and point-supported type clamping of the curtain wall is realized by the clamping plates on the end of the claw arm, which enables the stability and security of the structure of curtain wall.

In the connecting device according to the present invention, the claw arm is hidden in the space between the curtain walls, and thus the whole appearance of curtain wall is beautified.

Furthermore, it is unnecessary to provide through holes on the glass wall units since the connecting device clamps adjacent curtain wall units, so that the assembly is more convenient.

REFERENCE NUMERAL

Figure 1:
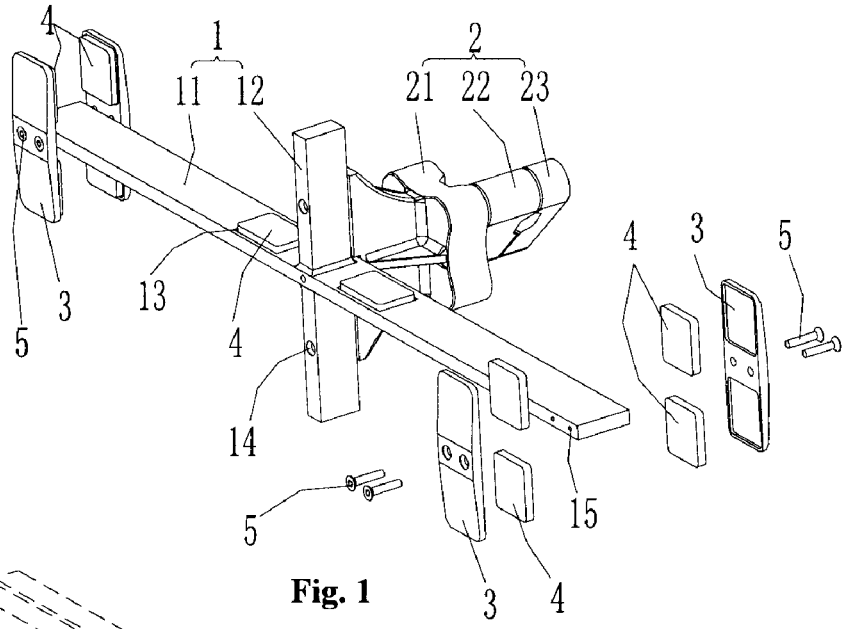
FIG. 1 is a schematic perspective view showing a first embodiment of a connecting device for curtain wall units according to the present invention, wherein the right portion in FIG. 1 is shown in exploded state.

1—claw arm,
11—horizontal arm,
12—vertical arm,
13—recess,
14—mounting hole,
15—mounting hole
2—claw base,
21—outer base,
22—middle base,
23—inner base
3—clamping plate
4—spacer plate
5—screw
6—curtain wall unit
7—standing rope

DETAILED DESCRIPTION OF THE INVENTION

The present invention will further described in the following embodiments accompanying with the drawings.

The terms "outer" and "inner" are relative to the position of the supporting structure of the curtain wall units, wherein "inner" relates to a position close to the supporting structure, and "outer" relates to a position distant from the supporting structure.

Embodiment 1

Referring to FIG. 1 to FIG. 4, a connecting device for curtain wall units comprises a claw arm 1, a plurality of clamping plates 3 and a claw base 2.

The claw arm 1 comprises two horizontal arms 11 and two vertical arms 12 which are fixed to be cross-shaped. The top surface of the horizontal arm 11 is provided with a recess 13 near the central portion, and the recess 13 is for receiving a spacer plate 4 which is protruded out of the top surface of the horizontal arm 11. The two horizontal arms 11 are provided with a plurality of through mounting holes 15 at the end distant from the end of the vertical arm 12. The two vertical arms 12 are provided with through mounting holes 14 respectively at the central portion. The horizontal arm 11 and the vertical arm 12 may be formed by molding integrally, or coupled to each other by welding or other fastening means.

The claw base 2 comprises an outer base 21, a middle base 22 and an inner base 23. The outer base 21, the middle base 22 and the inner base 23 are fixed to each other by bolt fastening. The joint surfaces of the outer base 21 and of the middle base 22 are both provided with mounting grooves which are right against each other to form a first through mounting hole. The joint surfaces of the middle base 22 and the inner base 23 are both provided with mounting grooves which are also right against each other to form a second through mounting hole. The extension axes of the first mounting hole and of the second mounting hole form a certain degree, while the diameter of the first mounting hole and of the second mounting hole matches with the outer diameter of the standing rope 7. A screw travels through the mounting hole 14 of the vertical arm 12 and screwed into the outer end of the outer base 21 to joint the claw arm 1 and the claw base 2. A spacer plate 4 is provided between the vertical arm 12 and the outer base 21.

Each two clamping plates 3 which face right against each other are fixed to the two ends of the mounting hole 15 on the horizontal arm 11, i.e. correspondingly fixed to the outer end and the inner end of the horizontal arm 11 to clamp the curtain wall unit 6. A spacer plate 4 is provided between the clamping plate 3 and the curtain wall unit 6.

Figure 2:
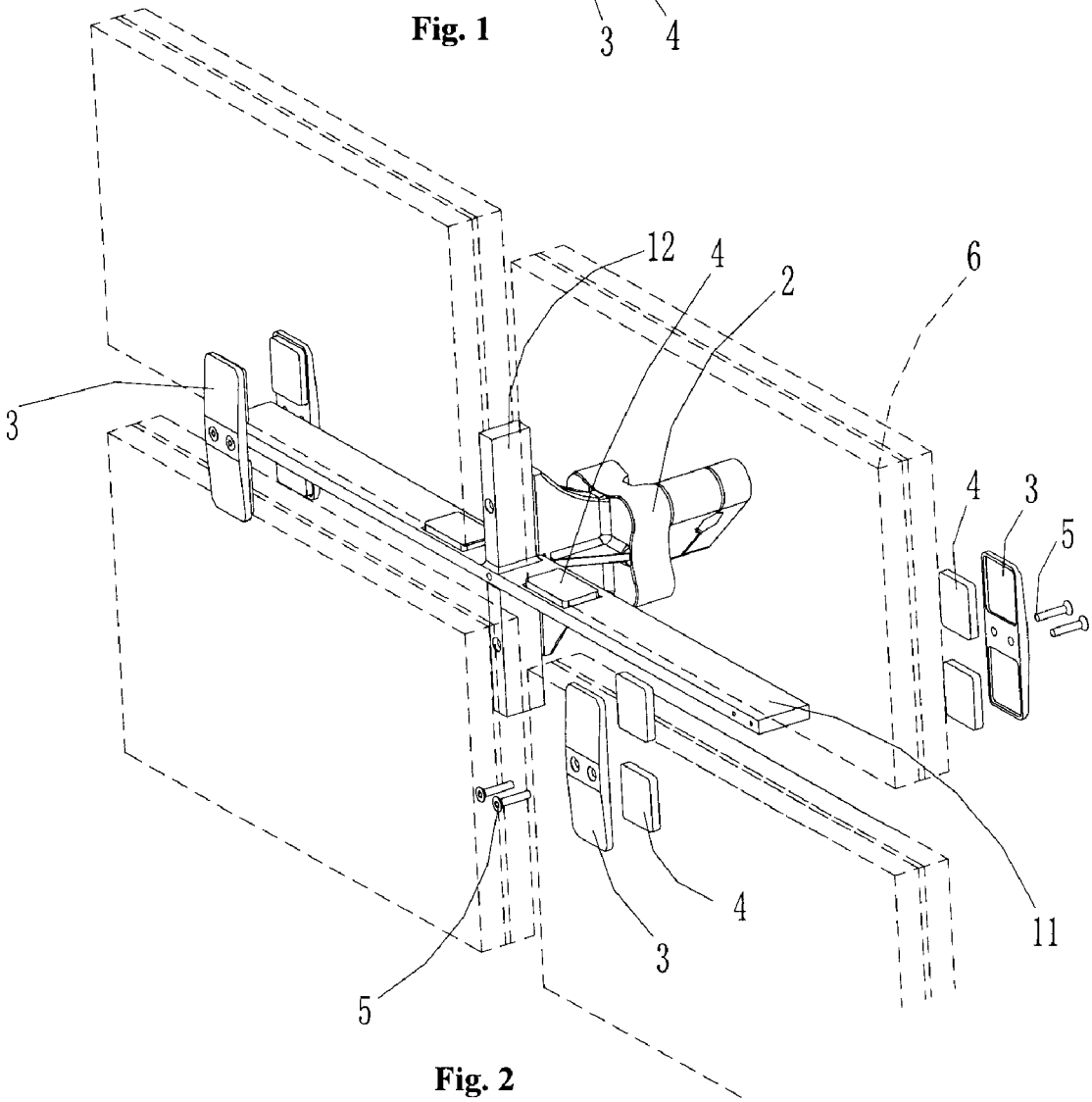
FIG. 2 is a schematic perspective view showing the first embodiment of the connecting device used in curtain wall assembly, wherein the right portion in FIG. 2 is shown in exploded state.
Figure 3:
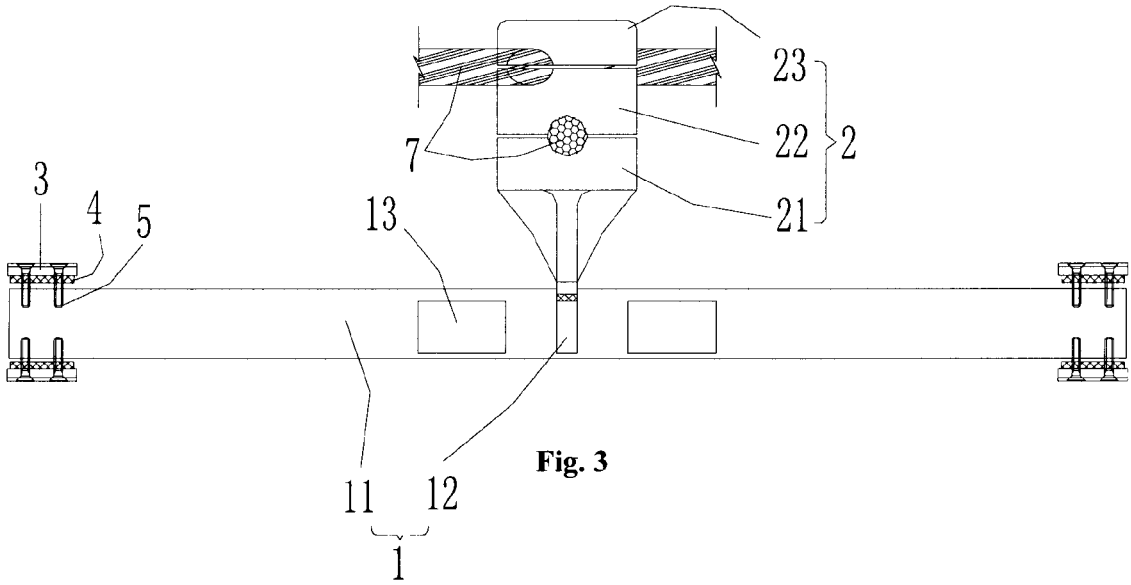
FIG. 3 is a top view of the first embodiment of the connecting device according to the present invention.
Figure 4:
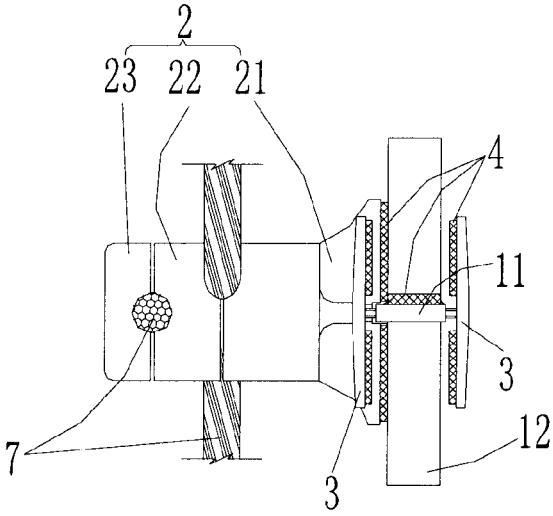
FIG. 4 is a left view of the first embodiment of the connecting device according to the present invention.

In the whole curtain wall, two horizontal arms 11 and two vertical arms 12 of each connecting device are respectively disposed among four adjacent curtain wall units 6, as shown in FIG. 2, and the claw arm 1 is hidden in the space between curtain wall units 6 to enable the whole curtain wall to be more beautiful in appearance. Each horizontal arm 11 bears the weight of a curtain wall unit 6, and two clamping plates 3 clamp two curtain wall units 6 which are above and below the horizontal arm 11 respectively. That is to say, each curtain wall unit 6 is supported by the horizontal arm 11 below the curtain wall unit, and is clamped at the middle of the upper edge portion by two clamping plates 3 and further clamped at the middle of the lower edge portion by two clamping plates 3, so that the curtain wall unit 6 is fixed.

The connecting device of this embodiment is mounted on a standing rope. However, the connecting according to the present invention may be mounted on other supporting structures such as a frame or a ribbed plate by using a corresponding structure of the claw base.

Embodiment 2

Figure 5:
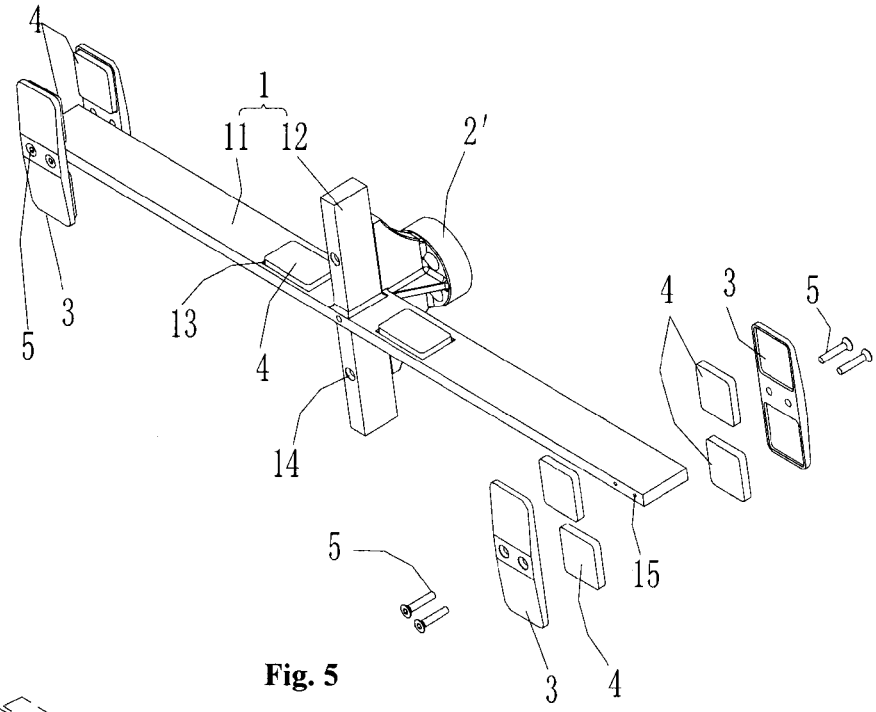
FIG. 5 is a schematic perspective view showing a second embodiment of a connecting device for curtain wall units according to the present invention, wherein the right portion in FIG. 5 is shown in exploded state.
Figure 6:
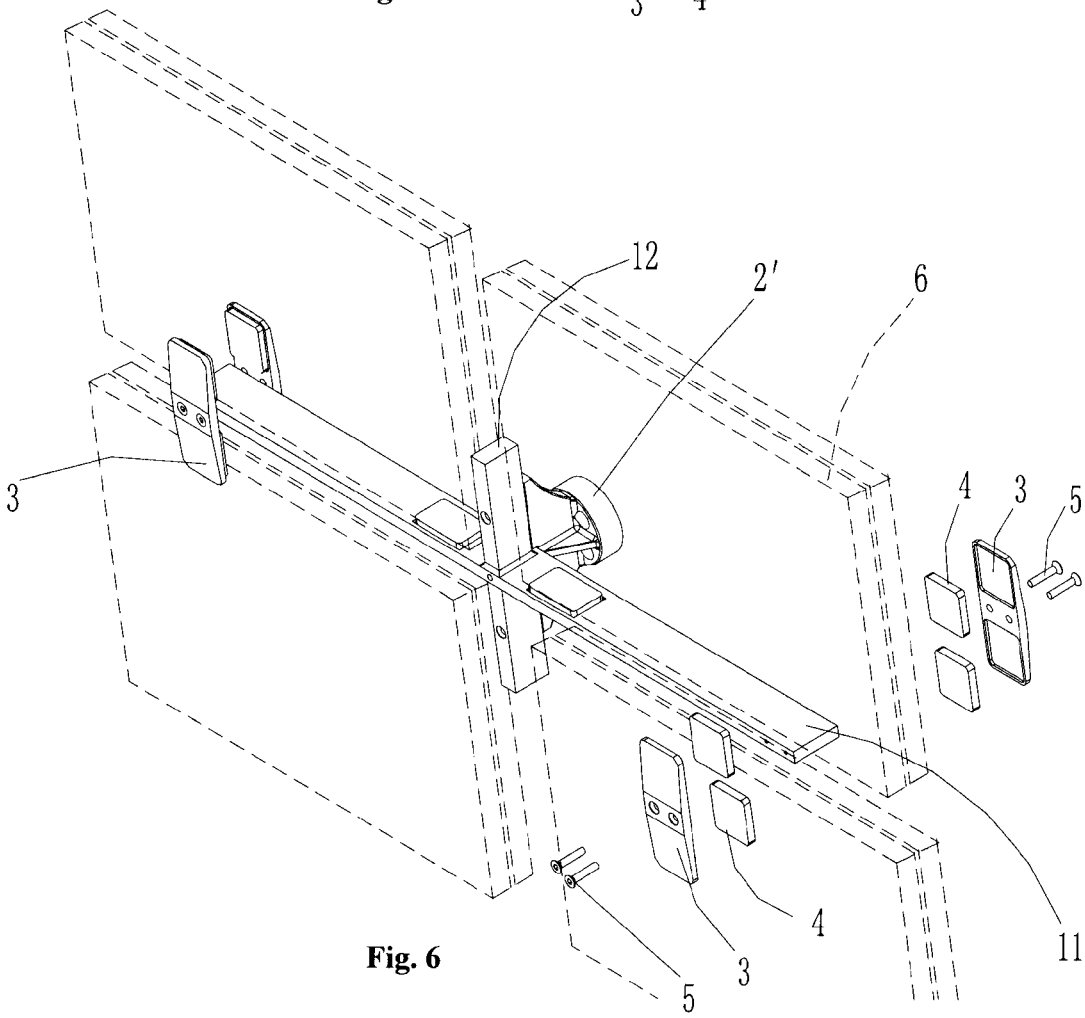
FIG. 6 is a schematic perspective view showing the second embodiment of the connecting device used in the curtain wall assembly, wherein the right portion in FIG. 6 is shown in exploded state.

Referring to FIGS. 5 and 6, this embodiment is similar to the Embodiment 1. The only difference is that the claw base 2' is provided with a plurality of mounting holes for coupling with the frame via screw, that is to say, the structure of the claw base 2' is adapted to match with the frame.

In the above-mentioned embodiments, the connecting device is of four claws. However, the connecting device may be also designed to have one, two or three claws to form a "—"-shaped, "L"-shaped or "⊥"-shaped claw arm respectively which is then arranged in different positions for assembling one, two or three adjacent curtain wall units.

The connecting device of the present invention may be used for curtain wall units made of glass or other materials such as stone, while the curtain wall units are assembled by clamping without the necessary of providing through holes therein.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A connecting device for supporting a plurality of curtain wall units, comprising:

a claw arm having a horizontal arm for supporting adjacent ones of the curtain wall units;

a plurality of clamping plates, a pair of said clamping plates fixed on the horizontal arm to clamp the curtain wall units; and a claw base protruding from a supporting structure of the curtain wall units, the claw base having a first through opening in a horizontal direction for passing a first standing rope therethrough and a second through opening in a vertical direction for passing a second standing rope therethrough, and the claw base being connected to an intermediate portion of the claw arm.

2. The connecting device of claim 1, wherein the claw arm further comprises a vertical arm integrated with the horizontal arm.

3. The connecting device of claim 2, wherein the claw arm comprises two horizontal arms and two vertical arms which are fixed to each other to be cross-shaped and disposed among four adjacent curtain wall units.

4. The connecting device of claim 1, wherein a top surface of the horizontal arm is provided with a recess for receiving a spacer plate.

5. The connecting device of claim 1, wherein said clamping plates are fixed right against each other on the outer surface and the inner surface respectively.

6. The connecting device of claim 1, wherein said clamping plates are mounted on an end of the horizontal arm distant from the claw base.

7. The connecting device of claim 1, wherein each of the clamping plates is fixed to the horizontal arm by screw.

8. The connecting device of claim 1, wherein the claw arm is fixed to the claw base by screw.

9. The connecting device of claim 1, wherein the claw base is fixed to a frame of the curtain wall or a ribbed plate of the curtain wall.

* * * * *